US006081977A

United States Patent [19]

Mark et al.

[11] Patent Number: 6,081,977

[45] **Date of Patent: *Jul. 4, 2000**

[54] CLOSURE FOR FOOTWEAR, CLOTHING, TENTS, RUCKSACKS

[76] Inventors: Rudolf Mark, Spital am Phyhrn 152; Thomas Mark, Spital am Phyhrn 204, both of A-4582 Spital am Pyhrn, Austria

[ * ] Notice: This patent issued on a continued prosecution application filed under 37 CFR 1.53(d), and is subject to the twenty year patent term provisions of 35 U.S.C. 154(a)(2).

[21] Appl. No.: 09/051,807

[22] PCT Filed: Oct. 4, 1996

[86] PCT No.: PCT/AT96/00183

§ 371 Date: Apr. 16, 1998

§ 102(e) Date: Apr. 16, 1998

[87] PCT Pub. No.: WO97/14328

PCT Pub. Date: Apr. 24, 1997

[30] Foreign Application Priority Data

Oct. 18, 1995 [AT] Austria ..... 1729/95

[51] Int. Cl.[7] ..... A43C 5/00

[52] U.S. Cl. ..... 24/712.7; 24/712.1; 24/713.5

[58] Field of Search ..... 74/713.5, 712.5, 74/712.7, 712.9, 712.1; 36/50.1

[56] References Cited

U.S. PATENT DOCUMENTS

| | | | |
|---|---|---|---|
| 871,528 | 11/1907 | Senn | 24/713.5 |
| 881,421 | 3/1908 | Lehmann | 24/713.5 |
| 1,068,241 | 7/1913 | Hluchy | 24/713.5 |
| 4,807,333 | 2/1989 | Boden | 24/117 |

FOREIGN PATENT DOCUMENTS

| | | | |
|---|---|---|---|
| 242 560 B | 9/1965 | Austria . | |
| 0 398 303A | 5/1990 | European Pat. Off. . | |
| 0 620 381 A1 | 4/1994 | European Pat. Off. . | |
| 424158 | 5/1911 | France | 24/713.5 |
| 985 569 | 7/1951 | France . | |
| 1 097 881 | 7/1955 | France . | |
| 17 036 C | 9/1881 | Germany . | |
| 1 727 138 | 7/1956 | Germany . | |
| 1 901 342 U | 9/1964 | Germany . | |
| 411 606 | 6/1934 | United Kingdom . | |
| WO 95/18552 | 7/1995 | WIPO . | |

*Primary Examiner*—James R. Brittain
*Attorney, Agent, or Firm*—Alston & Bird LLP

[57] ABSTRACT

The invention relates to a fastening mechanism (1) for shoes, articles of clothing, tents, rucksacks etc. with a lace or tape-like tying element (2) which is inserted into a guiding tab (9) designed as a hook or eye, which at least in an end region (15) which is opposite a fastening tab (4) connected to the guiding tab (9), has a base web (16), which spaces apart the facing inner surfaces (18) of two arms (10) of the guiding tab (9) at a distance (19), whereby the inner surfaces (18) with the base web (16) form a housing chamber (20) for the tying element (2), in which a reversing element (21) for the tying element (2) is arranged, whereby the reversing element (21) is arranged at a distance (24) from the base web (16) in the direction of the fastening tab (4) and has a height (27) which corresponds at least to the distance (19).

17 Claims, 6 Drawing Sheets

CLOSURE FOR FOOTWEAR, CLOTHING, TENTS, RUCKSACKS

The invention relates to a fastening mechanism for shoes, articles of clothing, tents or rucksacks etc. with a lace or tape-like tying element.

A fastening mechanism is already known, in particular a clamping mechanism for a shoelace according to EP-B1-0 398 303 of the same Applicant, which comprises a fastening tab and a supporting body having two side walls, between which there is a free space for the shoelace. The free space in the form of a recess comprises a clamping element, which in longitudinal guides arranged in the side walls can be moved from a clamping position into an open position. The shoelace is guided between the clamping element and a stop delimiting the recess opposite the fastening tab and wraps around the clamping element on the side facing away from the stop.

The above tried and tested clamping mechanism has a disadvantage however in that the shoelace runs between the underside of the supporting body and a surface of the shoe, which on lacing the shoe results in a point or linear pressure acting on the surface and thus on the body of the shoe wearer, reducing the comfort of the shoe or article of clothing respectively. Furthermore, it is very a time-consuming and complicated process to insert and guide the shoelace in or through the supporting body. In addition, with a rigid arrangement of the clamping element there is an increased risk of abrasive wear to the shoelace.

The objective of the invention is therefore to create a fastening mechanism which is characterised in that the article of clothing, for example a shoe, is very comfortable for the wearer. Furthermore, the fastening mechanism should be easy to thread, which is desirable in particular in the case of rucksacks or tents.

In addition, the objective is that along an opening of the article of clothing or the rucksack or tent to be fastened as many fastening mechanisms as possible should be arranged consecutively in order to obtain an even and tight fastening of the opening, and/or the tying element should be secured against movement in opening direction.

The said objective of the invention is achieved according to the features of one embodiment of the invention. The surprising advantage is that the tying element does not rest on the upper side of an article of clothing, thus avoiding a point or linear pressure on said surface and increasing the comfort of the article of clothing for the wearer. Furthermore, an angle, defined by a section running into the fastening mechanism and a section of the tying element running out of the latter can be reduced, thus permitting a reduction in the distances between consecutively arranged fastening mechanisms in an opening of an article of clothing and thereby an even and tight fastening of the opening.

An embodiment according to claim 2 is advantageous in that a low-friction movement of the tying element relative to the fastening mechanism is achieved and thus the wear of the tying element is reduced.

A further embodiment of the invention in which the rotary body is a ball and is rotably mounted in opposite openings of the arms is also advantageous in that the low-friction and low-wearing guiding of the tying element is performed on a spherical surface and thus in any dimension, so that both the lacing up and tightening of the tying element can be performed easily.

A still further embodiment in which the rotary body is arranged rotably about an axis of rotation arranged rigidly in the arms is also possible in which wear to the exterior of the reversing element is avoided, and the easy rotational movement of the reversing element is maintained, in particular in the case of a dirty fastening mechanism.

The invention also provides a fastening mechanism in which the rotary body is in the form of a cylinder having cylinder extensions rotably mounted in the opposite openings of the arms, by which the production costs of the fastening mechanism can be maintained without compromising the comfort for the wearer, the low wear and simple lacing of the tying element.

An embodiment of the invention in which the reversing element is a cylindrical projection running between the arms and extending perpendicularly to a bearing surface of the fastening tab is also advantageous in that the assembly costs of such a fastening mechanism are reduced and production is thus economical.

Furthermore, an embodiment in which the projection is connected in one piece which one of the arms of the guiding tab and is in the form of a hollow cylinder is advantageous, in which the weight of such a fastening mechanism is reduced whilst maintaining optimum rigidity and strength.

An embodiment in which an end region of the projection is spherical or ball-shaped is also advantageous in which sharp edges are avoided and the wear of the tying element is reduced.

A variant in which the arms of the guiding tab taper conically in the direction of the base web is also possible in which the fastening mechanism can be designed to be extremely compact and low in height, which is desirable for sports shoes for example, and also tents. In addition, the guiding of the reversing element in the guiding tab is improved.

Also described is a preferred embodiment in which material is saved during production and thus costs are reduced.

Also described is a further advantageous variant in which the assembly costs, the amount of material required and thus the production costs are further reduced without compromising the strength properties.

A design according to claim 12 is also advantageous, in which the fastening mechanism can be designed to be light in weight and to have high resistance to unfavourable weather conditions.

A further embodiment of the invention includes a clamping element arranged in the housing chamber of the guiding tab, the clamping element having a recess in which the reversing element is arranged. Accordingly, the tying element is clamped so that different sections of the tying element are pressurised by different amounts of stress inside the tying element, which is advantageous in particular in the transition regions from the foot to the thigh.

A design in which one or more of the parts of the fastening mechanism are made of a non-rusting material has the advantage that the fastening mechanism is weather-resistant and can thus be used in difficult conditions, in particular for climbing boots or tents.

An embodiment in which the housing chamber for the tying element is closed in the direction of the fastening tab by a supporting web parallel to the base web has the advantage that pressure acting on the fastening mechanism, which could risk permanent deformation, can be absorbed and distributed evenly over the article of clothing.

Finally, a design in which the supporting web is formed by an inclined arm running parallel to the clamping arm and connecting an extension of the fastening tab with the cover arm is possible in which the fastening mechanism, whilst maintaining its capacity for absorbing pressure can be designed to be low in height.

To improve understanding of the invention the latter is explained in more detail with reference to the embodiments illustrated in the drawings.

Figure 1:
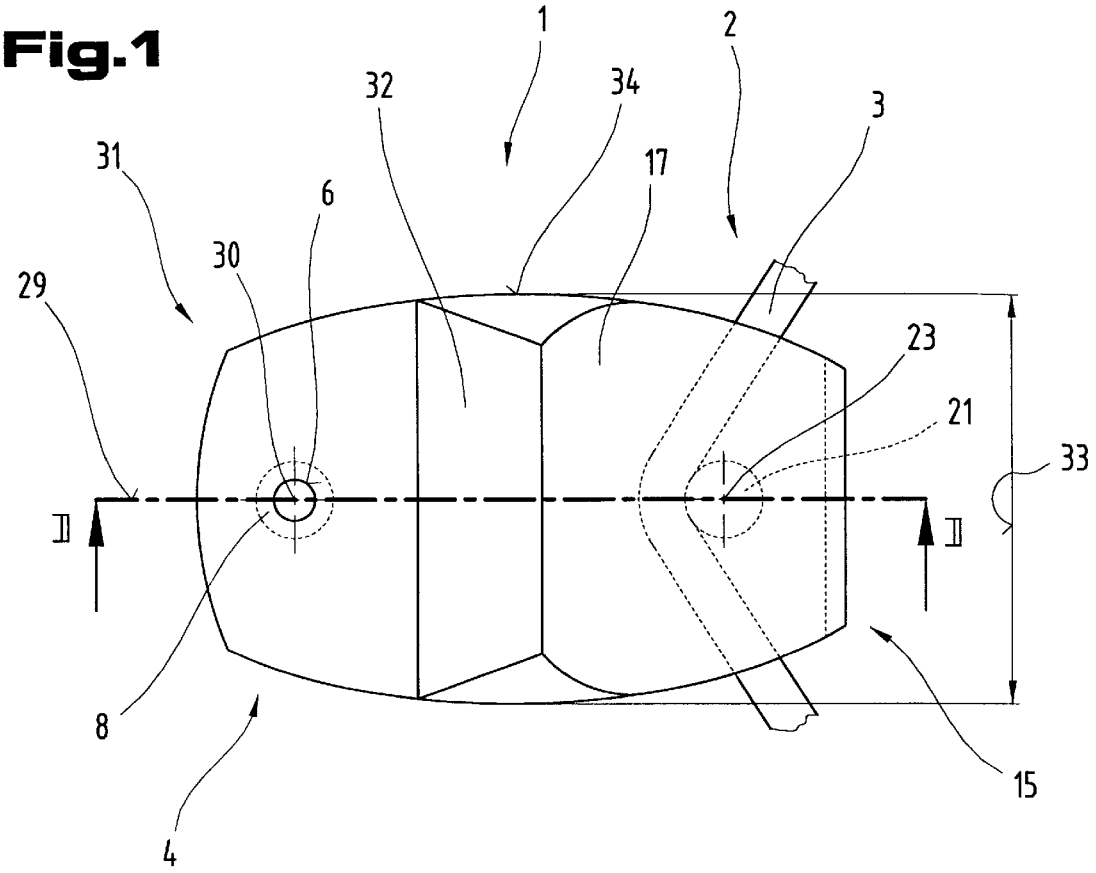
FIG. 1 shows a fastening mechanism according to the invention in plan view.
Figure 2:
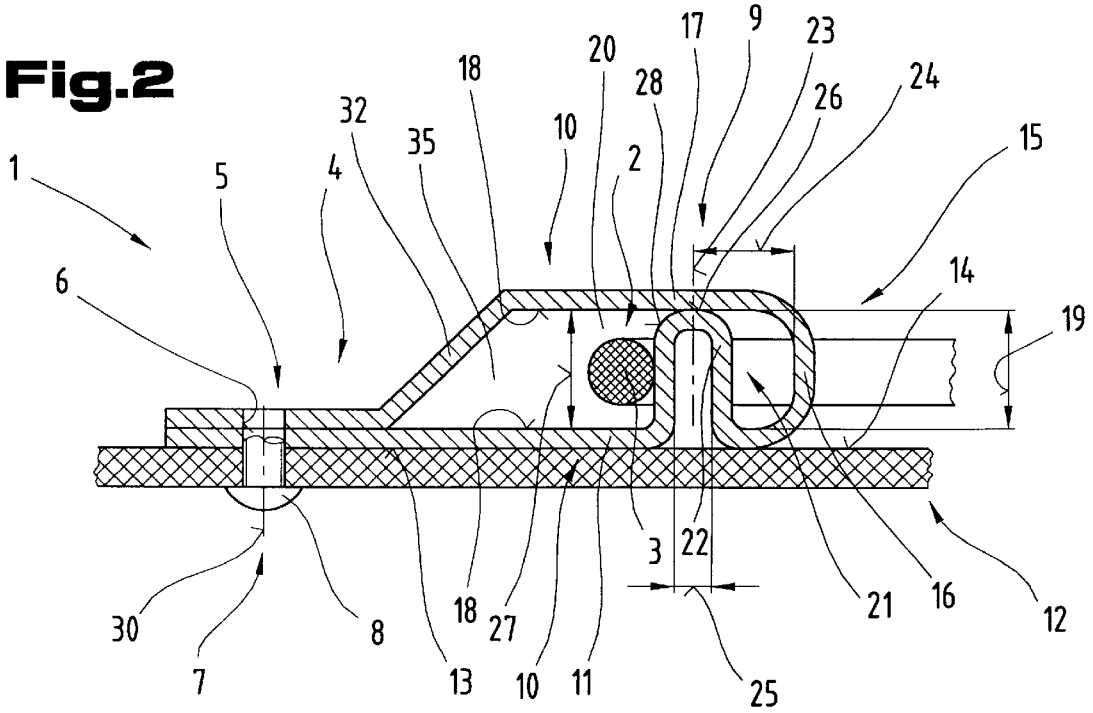
FIG. 2 shows the fastening mechanism in cross section, along the lines II—II of FIG. 1.

In FIGS. 1 and 2, which are described together, a fastening mechanism 1 with a lace or tape-like tying element 2, e.g. for shoes, articles of clothing, tents and rucksacks, is shown. The tying element 2 in the present embodiment is in the form of a shoelace 3. The fastening mechanism 1 comprises a fastening tab 4, which has an opening 5, for example a circular bore 6, for a fastening element 7, such as for example a rivet 8. The fastening mechanism 1 also comprises a guiding tab 9, designed for example as a hook or eye, which is connected in one piece with the fastening tab 4, and into which the tying element 2 is inserted. It is also possible however to arrange the guiding tab 9 pivotably on the fastening tab 4. The guiding tab 9 has arms 10, one of which is designed as a bearing arm 11, which together with a side of the fastening tab 4 facing an article of clothing 12 forms a bearing surface 13 on which the fastening mechanism 1 rests on the upper side 14 of the article of clothing 12, tent or rucksack respectively.

In an end region 15 of the guiding tab 9 opposite to the fastening tab 4, the bearing arm 11 comprises a base web 16 running against the upper side 14, which spaces apart a cover arm 17 forming arm 10 and is roughly parallel to the bearing arm 11. The facing inner surfaces 18 of the bearing arm 11 and the cover arm 17 are thus spaced apart by a distance 19 and form with the base web 16 a housing chamber 20 for the tying element 2, for example the shoelace 3.

The base web 16 is preferably concave in the direction of the end region 15. It can however also be convex relative to the end region 15 or at right angles to the arms 10. In the housing chamber 20 is a reversing element 21, connected in one piece with the bearing arm 11 and projecting over the latter perpendicular to and opposite to the bearing surface 13, which reversing element 21 extends up to the inner surface 18 of the cover arm 17 and is designed for example as a cylindrical, in particular hollow cylindrical projection 22, which is symmetrical relative to a middle axis 23 roughly at right angles to the upper side 14. The projection 22 can however also be connected in one piece with the cover arm 17 and project over the latter in the direction of the bearing arm 11 or the upper side 14 of the article of clothing 12. An end region of the projection 22 facing the bearing arm 11 or the cover arm 17 is in this case designed to be spherical or ball-shaped. The reversing element 21, in particular the projection 22, is spaced apart from the base web 16 by a distance 24 measured parallel to the upper side 14 in the direction of the fastening tab 4, which distance is greater than half the outside diameter 25 of the reversing element 21 defining the projection 22. The fastening tab 4, the arms 10, the base web 16 and if necessary the reversing element 21 can be designed in particular as a one piece sheet metal formed part. A surface 26 of the reversing element 21 resting against the inner surface 18 of the cover arm 17 is spaced apart from the inner surface 18 of the bearing arm 11 by a height 27 opposite the upper side 14 which is at least equal to distance 19.

The tying element 2, in particular the shoelace 3, slides on an outer surface 28 of the projection 22, which runs in the half outside diameter 25 around the middle axis 23. The fastening mechanism 1 is designed to be symmetrical about a longitudinal axis 29, whereby both the middle axis 23 of the reversing element 21 and an axis 30 parallel thereto in the centre of the bore 6 lie in said longitudinal axis 29. The fastening tab 4 follows a curved path at an end region 31 opposite end region 15, which is concave relative to the bore 6.

Between the fastening tab 4 and the cover arm 17 is an inclined arm 32 connecting the two together. The bearing arm 11 has a width 33 at right angles to the longitudinal axis 29 which is greatest in the region between the reversing element 21 and the fastening element 7 and decreases towards end region 15 and end region 31. The inclined arm 32 runs from an outline 34 of the beating arm 11 or the fastening tab 4 defined by the width 33 and tapers conically towards the cover arm 17. The shoelace 3 is inserted into an inner chamber 35 of the housing chamber 20 defined by the outer surface 28 of the reversing element 21, the inner surfaces 18 of the bearing arm 11 and the cover arm as well as the inclined arm 32.

Figure 3:
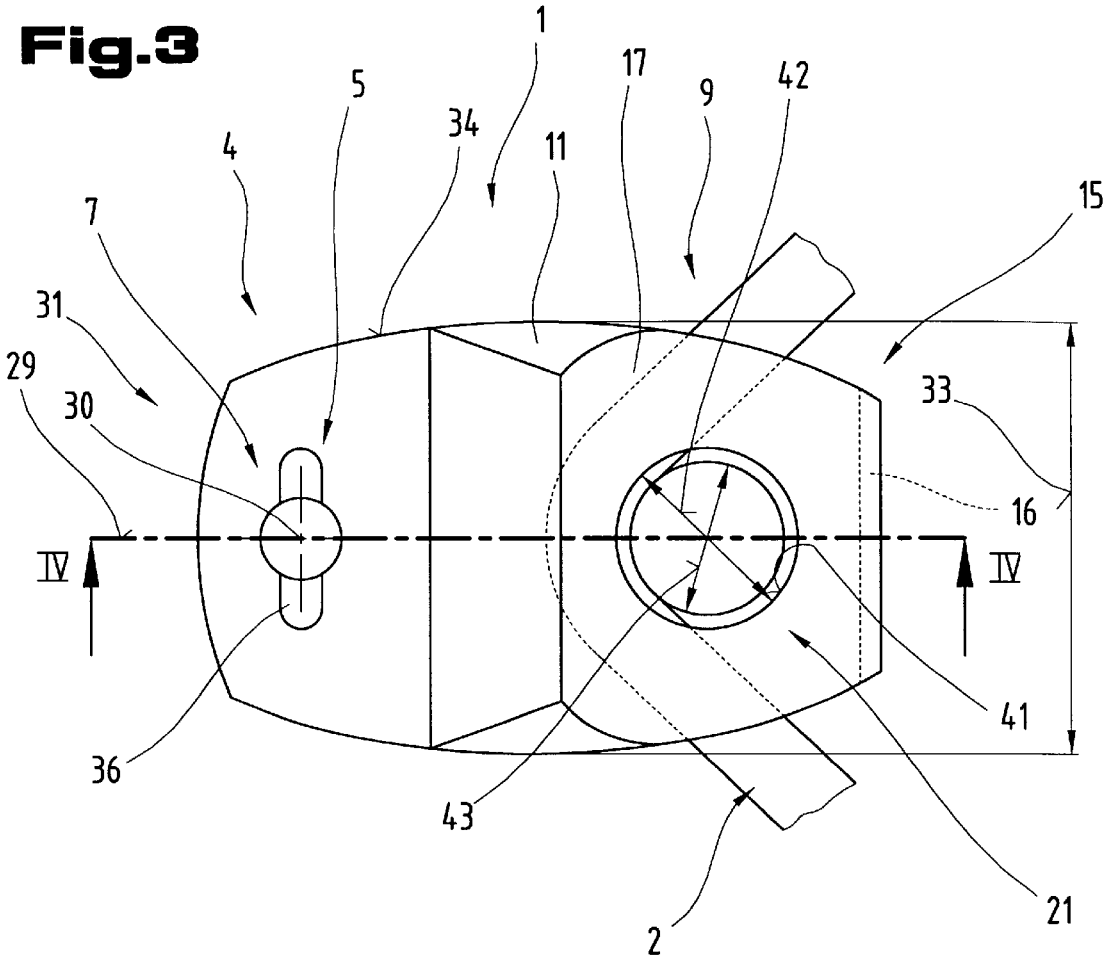
FIG. 3 shows a different embodiment of the fastening mechanism according to the invention in plan view.
Figure 4:
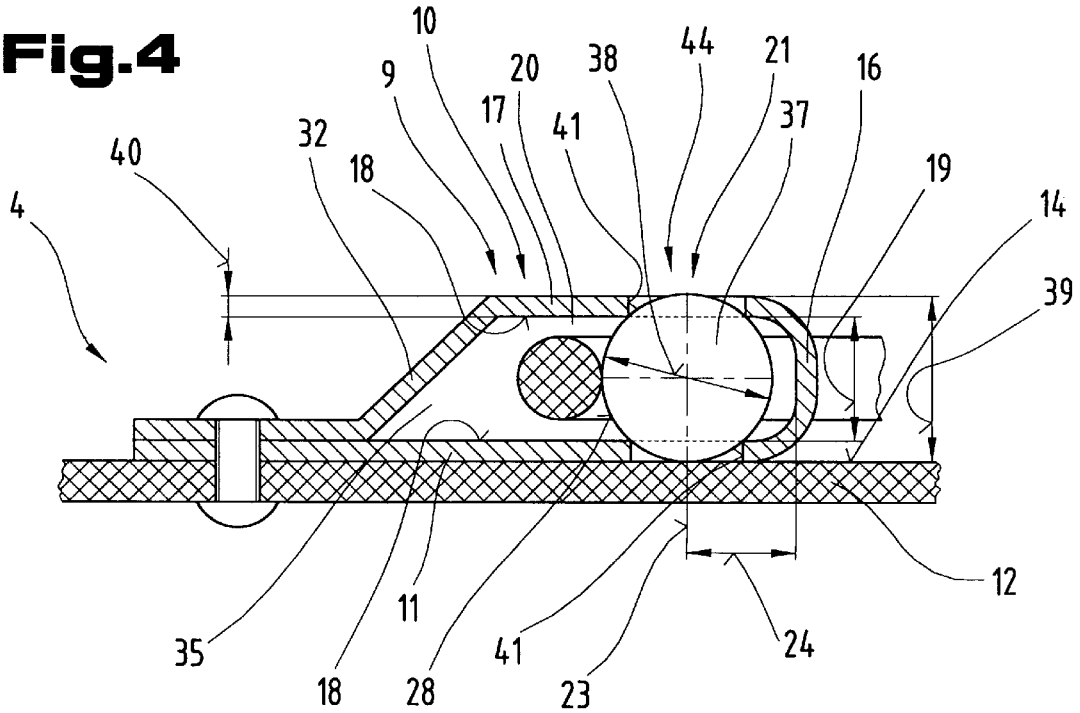
FIG. 4 shows the fastening mechanism in cross section, along the lines IV—IV of FIG. 3.

FIGS. 3 and 4 illustrate an additional embodiment of the fastening mechanism 1. The latter comprises the fastening tab 4 and the guiding tab 9, whereby the opening 5 in the fastening tab 4 is designed e.g. as a longitudinal hole 36. The fastening element 7 is guided through the longitudinal hole 36, the axis 30 of which lies on the longitudinal axis 29. The outline 34 is curved in the end region 31, and the width 33, because of the curve of the outline 34 of the fastening tab 4, the bearing arm 11 and the cover arm 17, widens from end region 31 towards end region 15 to a region between the fastening element 7 and the reversing element 21 and tapers from this region to the end region 15. The outline 34 is arranged symmetrically about the longitudinal axis 29. The base web 16 is for example at right angles to the longitudinal axis 29. The bearing arm 11 is roughly parallel to the upper side 14 of the article of clothing 12, which may also be a tent or a rucksack for example.

Between the bearing arm 11 and the cover arm 17 as well as between the base web 16 and the inclined arm 32 is the housing chamber 20 in which the reversing element 21 is arranged between the opposite inner surfaces 18 of the arms 10. The reversing element 21 is designed in the present embodiment as a ball 37, with a ball diameter 38 which is greater than the distance 19 delimited by the facing inner surfaces 18 of the cover arm 17 and the bearing arm 11. It is also greater than the total height 39 of the guiding tab 9 at right angles to the upper side 14, which derives from the sum of the distance 19 and a double wall thickness 40 of the bearing arm 11 or the cover arm 17.

The ball 37 has in its centre the middle axis 23 running at right angles to the upper side 14, which is spaced at the distance 24 from the base web 16 in the direction of the fastening tab 4. Congruent openings 41 are arranged concentrically around this middle axis 23, which are partly penetrated by the ball 37, and thus prevent the displacement of the ball inside the housing chamber 20. The openings 41 have an opening diameter 42 which is greater than a diameter 43 of the ball 37 lying in the plane of the inner surfaces 18 so that the ball 37 is positioned rotatably in the openings 41, and the bearing arm 11 and the cover arm 17 form a ball cage 44 with the openings 41. The tying element 2 is inserted into the inner chamber 35 defined by the ball 37, the inclined arm 32, the bearing arm 11 and the cover arm 17 and guided on the outer surface 28 of the ball 37.

Figure 5:
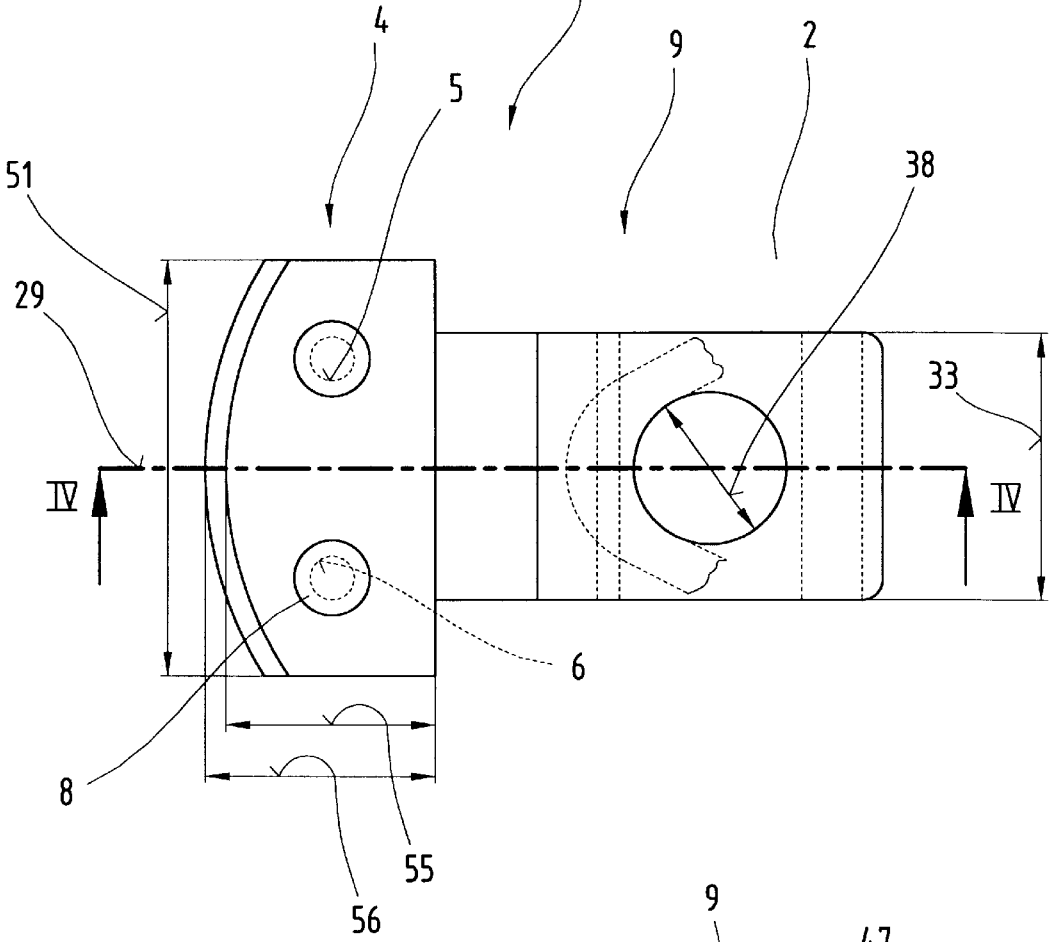
FIG. 5 shows a further embodiment of the fastening mechanism according to the invention in plan view.
Figure 6:
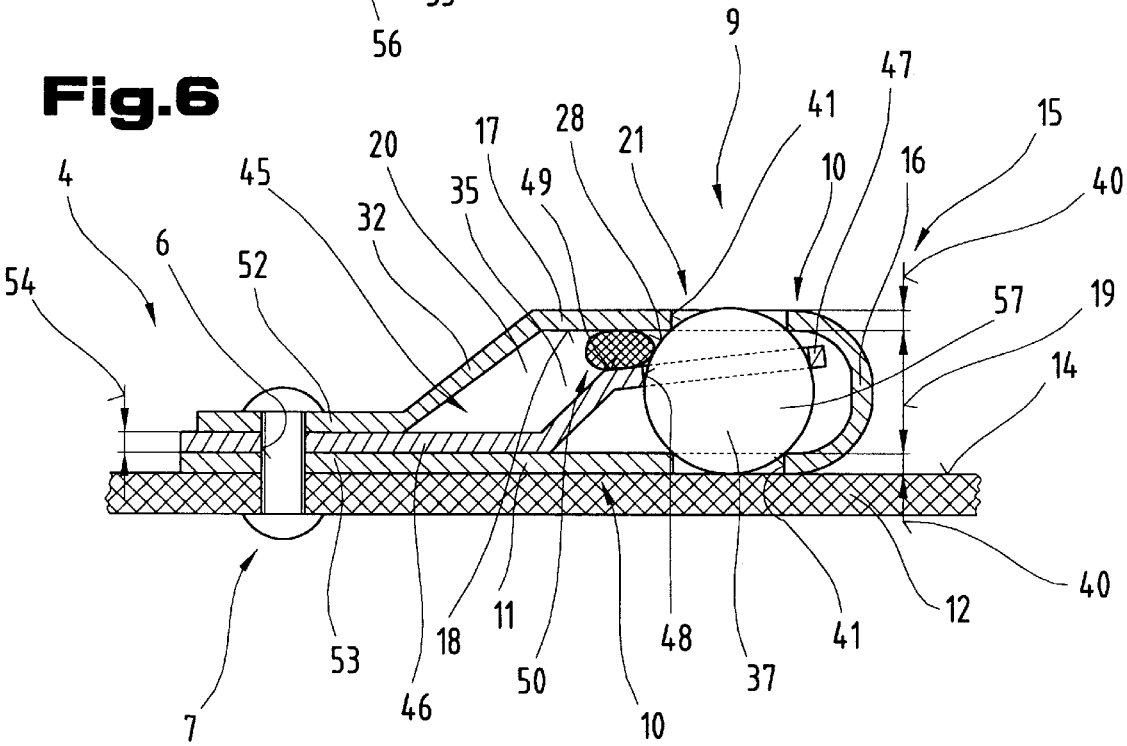
FIG. 6 shows the fastening mechanism in cross section along the lines VI—VI of FIG. 5.

In FIGS. 5 and 6 described below a different embodiment of the fastening mechanism 1 is illustrated, in which the reversing element 21 has a clamping element 45. The latter is arranged in the housing chamber 20 and comprises a fastening arm 46, which is arranged parallel to the upper side 14 of the article of clothing 12 in the fastening tab 4 and/or between the bearing arm 11 and the cover arm 17, and by means of the fastening element 7 inserted into the fastening tab 4 is connected immovably to the fastening tab 4.

In the direction of the end region 15 of the guiding tab 9 a clamping arm 47 is arranged on the fastening arm 46, preferably connected in one piece, which is inclined in the direction of the cover arm 17 or the bearing arm 11 and the base web 16. The clamping arm 47 can however also be inclined from the base web 16 in the direction of the fastening tab 4 and the bearing arm 11 or the cover arm 17. The clamping element 45, in particular the clamping arm 47, also comprises a recess 48 in which the reversing element 21, in particular the ball 37, is arranged. The ball 37 is mounted in the housing chamber 20 in the openings 41 of the bearing arm 11 and the cover arm 17, whereby the ball diameter 38 is equal to the sum of the distance 19 and the double wall thickness 40.

A surface 49 of the clamping arm 49 facing the inner surface 18 of the cover arm 17, which can be furnished with a smooth or rougher finish, forms with the outer surface 28 of the ball 37 and the inner surface 18 a clamping region 50, in which the tying element is drawn and pressed after the article of clothing 12 has been laced up. In this way the automatic untying of the tying element 2 is prevented and different stresses can be produced along the length of the tying element 2. In order to untie the tying element 2 the latter is moved back out of the clamping region into the inner chamber 35 and is easily displaceable in this way.

The fastening tab 4 comprises in this variant two bores 6 arranged symmetrically about the longitudinal axis 29 for the fastening elements 7 designed as rivets 8. The fastening tab 4 has also a tab width 51 measured at right angles to the longitudinal axis 29 which is greater than the width 33 of the guiding tabs 9. The fastening tab 4 and the bearing arm 11, the base web 16, the cover arm 17 and the inclined aim 32 are formed from a one piece sheet metal formed part, whereby the fastening tab 4 is formed in two layers by an extension 52, which is formed parallel to the upper side 14 on the inclined arm 32 at the opposite end to the base web 16 and an extension 53 which is an extension of the bearing arm 11.

The extension 52 is spaced from the extension 53 in the opposite direction to the upper side 14 by an arm thickness 54 of the fastening arm 46 of the clamping element 45, and has a length 55 parallel to the longitudinal axis 29 which is shorter than an arm length 56 of the extension 53 parallel thereto. It is also possible however to design the inclined arm 32 to be parallel to the clamping arm 47 of the clamping element 45 or parallel to the base web 16 and/or to design the fastening tab 4 as the extension 53. On the other hand it is also possible to design the fastening tab 4 in one layer by the extension 52 and to attach the fastening arm 46 of the clamping element 45 directly on the upper side 14 of the article of clothing 12. In this way at least one of the arms 10 of the fastening device 1 forms the fastening tab 4 with the opening 5. The inclined arm 32 running parallel to the clamping arm 47 thus connects the extension 52 of the fastening tab 4 with the cover arm 17.

Both the fastening tab 4 and the guiding tab 9 and/or the rotary body 57 or the reversing element 21 and/or the clamping element 45 can be made of a non-rusting metal or provided with suitable coatings.

Figure 7:
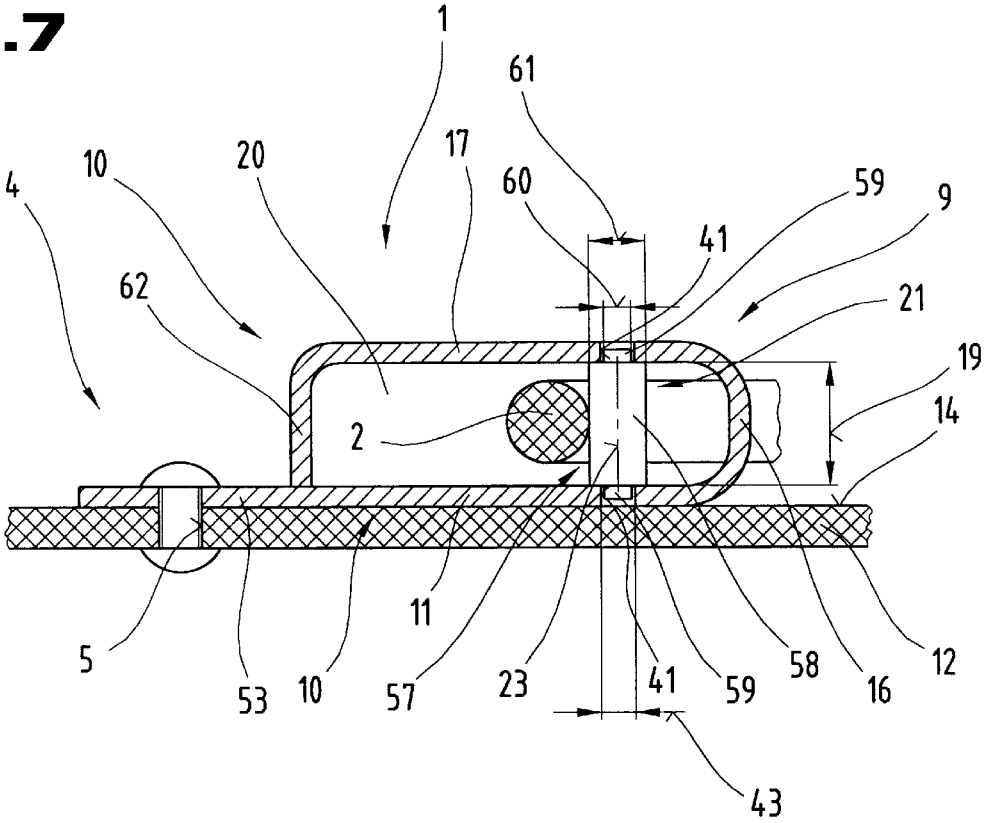
FIG. 7 shows a different variant of the fastening mechanism according to the invention, in cross section, in side view.

FIG. 7 shows a further embodiment of the fastening mechanism 1, in particular the guiding tab 9. The latter comprises the bearing arm 11 arranged parallel to the upper side 14 of the article of clothing 12 and the cover aim 17 parallel to the latter spaced apart by the distance 19. The bearing arm 11 and the cover arm 17 comprise opposite openings 41 which run concentrically around the middle axis 23. In the housing chamber 20 is the reversing element 21, which in this embodiment is designed as a rotationally symmetrical rotary body 57, in particular as a rotary cylinder 58, rotating about the middle axis 23 at right angles to the fastening tab 4. The latter runs concentrically about the middle axis 23 and comprises opposite cylinder extensions 59 in the direction of the bearing arm 11 and the cover arm 17, which are rotatably mounted in the opposite openings 41 of the arms 10 and have an extension diameter 60 which is smaller than the diameter 43 of the openings 41. A rotary cylinder diameter 61 is greater than the diameter 43 of the openings 41, which is why the rotary cylinder 58 is secured against movement in the direction of the middle axis 23. It is possible however, that in the arms 10, in particular in the openings 41, an axis of rotation connecting the arms 10 together is arranged rigidly, about which the rotary body 57 is mounted rotatably. The fastening tab 4 merely comprises the extension 53 of the bearing arm 11, so that at least one of the arms 10 of the fastening tab 9, forms the fastening tab 4 comprising the opening 5. The housing chamber 20 for the tying element 2 is designed to be closed by the bearing arm 11, cover arm 17, base web 16 and a support web 62 parallel to the base web 16.

Figure 8:
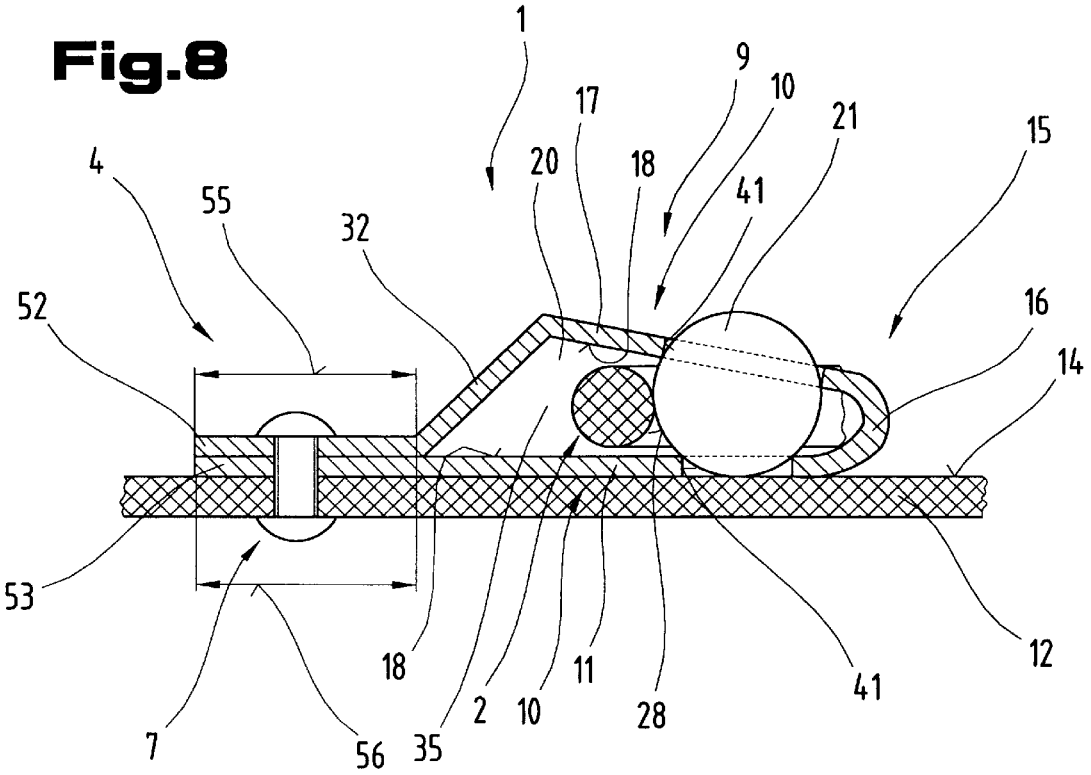
FIG. 8 shows a further embodiment of the fastening mechanism according to the invention, in cross section, in side view.

FIG. 8 shows a different variant of the fastening mechanism 1, in particular the guiding tab 9. In this case the bearing arm 11 is parallel to the upper side 14 of the article of clothing 12. The cover arm 17 however runs from an end of the inclined arm 32 facing away from the fastening tab 4 towards the base web 16, the housing chamber 20 tapering conically towards the base web 16. However, the bearing arm 11 or both arms 10 can be designed in this manner.

Both the bearing arm 11 and the cover arm 17 comprise corresponding openings 41 mounting the reversing element 21, and the tying element 2 is guided into the inner chamber 35 defined by the outer surface 28 of the reversing element 21, the inner surfaces 18 and the inclined arm 32. The fastening tab 4 is formed in two layers, whereby the extension 53 of the bearing arm 11 facing the upper side 14 that is its arm length 56 is equal to the length 55 of the extension 52 of the inclined arm 32. The fastening tab 4 is in turn connected by at least one fastening element 7 to the article of clothing 12.

Figure 9:
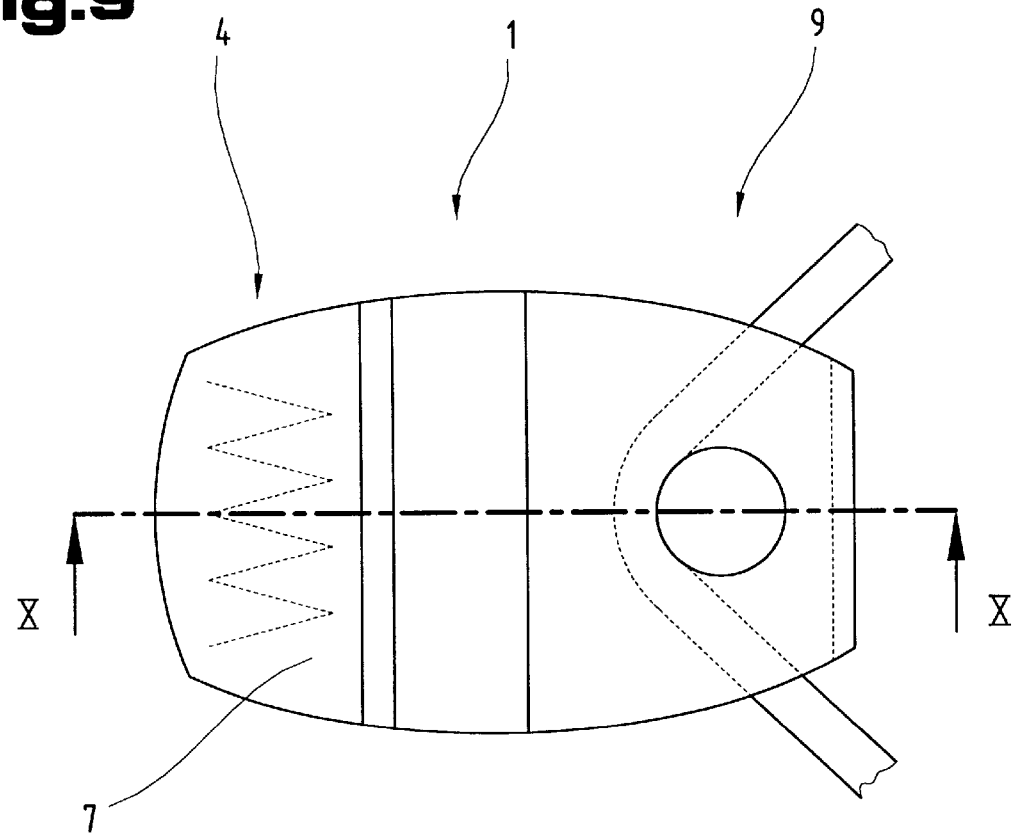
FIG. 9 shows a different embodiment of the fastening mechanism according to the invention in plan view.
Figure 10:
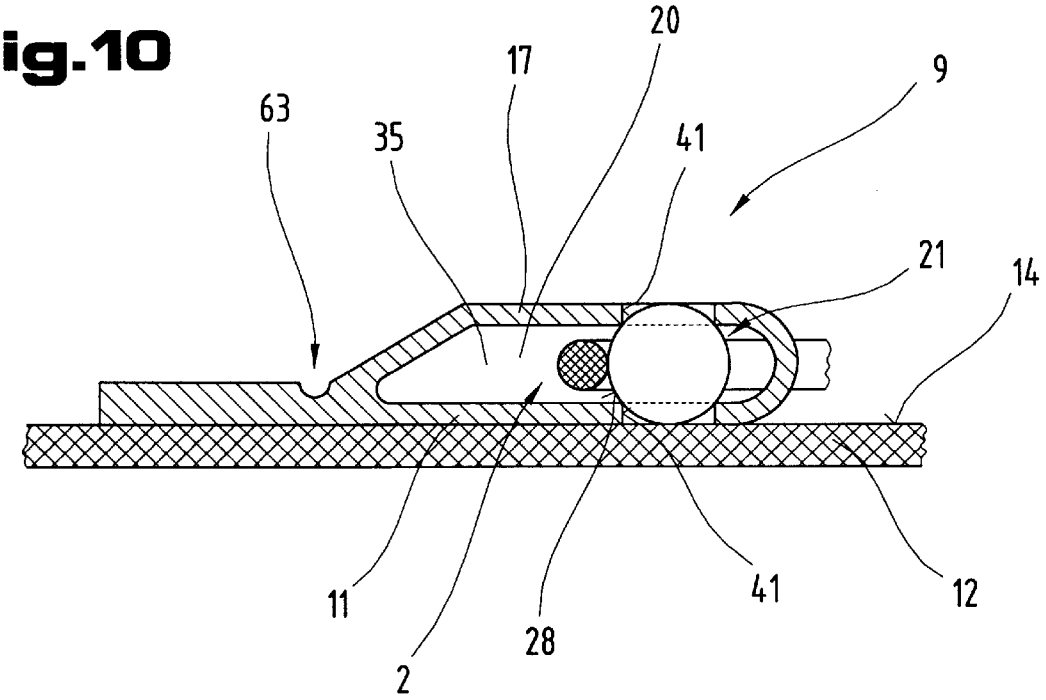
FIG. 10 shows the fastening mechanism, in cross section, along the lines X—X of FIG. 9.

Finally, in FIGS. 9 and 10, which are described together, a further development of the fastening mechanism 1 is shown. In this case both the fastening tab 4 and the guiding tab 9 mounting the reversing element 21 in a housing chamber 20 are in the form of plastic parts, whereby the fastening tab 4 and the guiding tab 9 are joined together in one piece. The fastening tab 4 is designed to be a single layer and with the fastening element 7 designed as a seam is arranged on the upper side 14 of the article of clothing 12. Between the fastening tab 4 and the guiding tab 9 there is weakening in the material 63 which permits movement of the guiding tab 9 relative to the fastening tab 4. The guiding tab 9 in turn comprises the bearing arm 11 and the cover arm 17 parallel thereto which both have openings 41 for the reversing element 21. The latter can be made of a non rusting metal for example and comprises the outer surface 28, on which the tying element 2 is guided inside the inner chamber 35.

Figure 11:
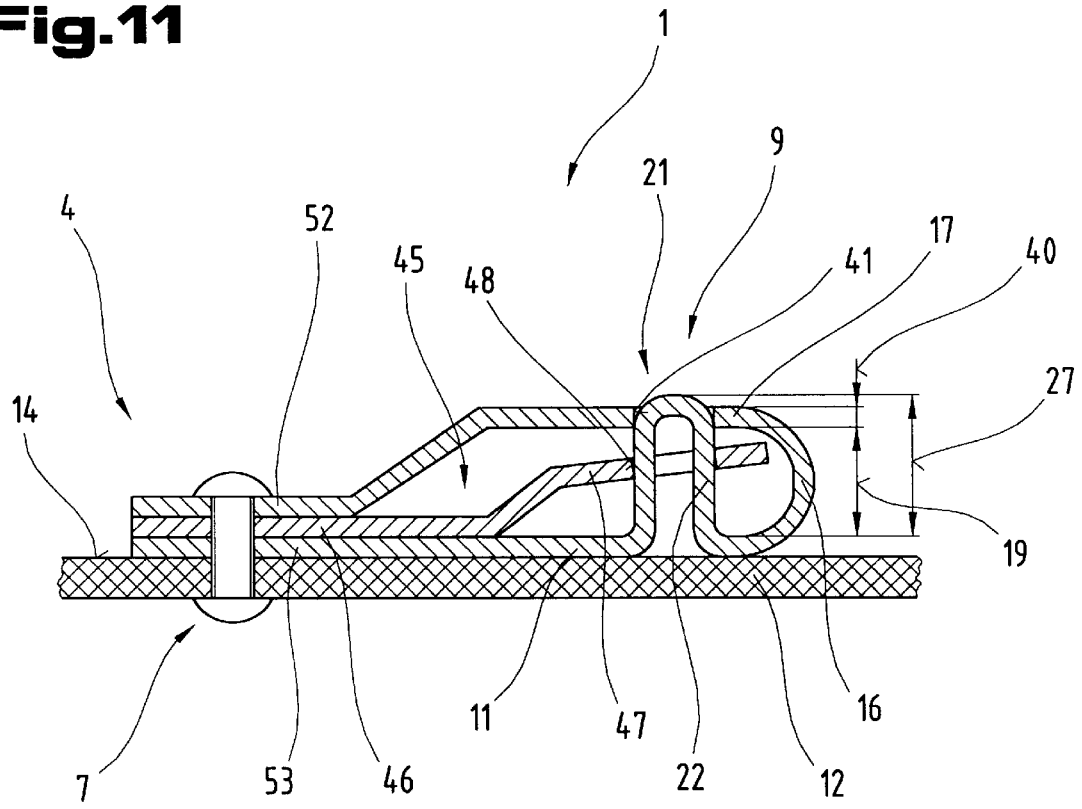
FIG. 11 shows a further embodiment of the fastening mechanism according to the invention in cross section, in side view.

Lastly, in FIG. 11 a further embodiment of the fastening mechanism 1 is shown. The latter comprises the fastening tab 4 which is arranged by the fastening element 7 on the article of clothing 12 on its upper side 14. The fastening arm 46 of the clamping element 45 is arranged between the extension 52 and extension 53 which clamping element 45 is also connected to the fastening tab 4 by means of the fastening element 7. The bearing arm 11 of the guiding tab 9 comprises the projection 22 formed in one piece and designed as a reversing element 21, which passes through the opening 41 of the cover arm 17 opposite the upper side 14. The height 27 of the projection 22 is greater than the sum of the distance 19 and the wall thickness 40. The clamping element 45 comprises in the direction of the base web 16, the clamping arm 47 formed on the fastening arm 46, which delimits the projection 22 passing through the recess 48 of the clamping arm 47.

Of course, it is possible for all of the variants to comprise the clamping element 45.

Furthermore, it should be pointed out that individual features, characterised in particular in the subclaims, can represent independent inventions.

Finally, it should be noted that to improve understanding of the invention the details depicted in the drawings are not always drawn to scale and are not always in proportion.

| List of Reference Numbers | |
|---|---|
| 1 | fastening mechanism |
| 2 | tying element |
| 3 | shoelace |
| 4 | fastening tab |
| 5 | opening |
| 6 | bore |
| 7 | fastening element |
| 8 | rivet |
| 9 | guiding tab |
| 10 | arm |
| 11 | bearing arm |
| 12 | article of clothing |
| 13 | bearing surface |
| 14 | upper side |
| 15 | end region |
| 16 | base web |
| 17 | cover arm |
| 18 | inner surface |
| 19 | distance |
| 20 | housing chamber |
| 21 | reversing element |
| 22 | projection |
| 23 | middle axis |

-continued

| List of Reference Numbers | |
|---|---|
| 24 | distance |
| 25 | outside diameter |
| 26 | surface |
| 27 | height |
| 28 | outer surface |
| 29 | longitudinal axis |
| 30 | axis |
| 31 | end region |
| 32 | inclined arm |
| 33 | width |
| 34 | outline |
| 35 | inner chamber |
| 36 | longitudinal hole |
| 37 | ball |
| 38 | ball diameter |
| 39 | total height |
| 40 | wall thickness |
| 41 | opening |
| 42 | opening diameter |
| 43 | diameter |
| 44 | ball cage |
| 45 | clamping element |
| 46 | fastening arm |
| 47 | clamping arm |
| 48 | recess |
| 49 | surface |
| 50 | clamping region |
| 51 | tab width |
| 52 | extension |
| 53 | extension |
| 54 | arm thickness |
| 55 | length |
| 56 | arm length |
| 57 | rotary body |
| 58 | rotary cylinder |
| 59 | cylinder extension |
| 60 | extension diameter |
| 61 | rotary cylinder diameter |
| 62 | support web |
| 63 | material weakening |

What is claimed is:

1. Fastening mechanism for receiving a lace or tape-like tying element, the fastening mechanism comprising a guiding tab adapted to receive said tying element therethrough and a fastening tab connected to the guiding tab, the guiding tab including two arms that are spaced apart and facing each other and a base web which spaces apart facing inner surfaces of the two arms of the guiding tab, the arms and the base web forming a housing chamber for the tying element, the fastening mechanism further comprising a reversing element for the tying element mounted within the housing chamber and defining an axis extending between the arms, the reversing element comprising a projection connected in one piece with one of the arms and extending from said one of the arms to the other arm, the fastening tab projecting from one end of the guiding tab along a direction generally perpendicular to the axis of the reversing element and being adapted to be fastened to an article by a fastener passing through the fastening tab and through said article.

2. Fastening mechanism according to claim 1, characterised in that the projection comprises a cylindrical projection running between the arms which extends perpendicularly to a bearing surface of the fastening tab adapted to rest on an upper side of an article.

3. Fastening mechanism according to claim 1, characterised in that the arms (10) of the guiding tab (9) taper conically in the direction of the base web (16).

4. Fastening mechanism according to claim 1, characterised in that at least one of the arms (10) of the guiding tab (9) forms the fastening tab (4) and defines an opening (5) for the passage of a fastener therethrough for fastening the fastening mechanism to an article.

5. Fastening mechanism according to claim 1, characterised in that the fastening (4), the base web (16) and the arms (10) are formed by a one piece sheet metal formed part.

6. Fastening mechanism according to claim 1, characterised in that the fastening tab (4) and the guiding tab (9) mounting the reversing element (21) in a housing chamber (20) are formed by a plastic part.

7. Fastening mechanism for receiving a lace or tape-like tying element, the fastening mechanism comprising a guiding tab adapted to receive said tying element therethrough and a fastening tab connected to the guiding tab, the guiding tab including a base arm having a generally planar surface adapted to lie against an article to which the fastening mechanism is affixed, the guiding tab further including a cover arm spaced from the base arm such that the two arms have inner surfaces that face each other, and a base web which spaces apart facing inner surfaces of the two arms of the guiding tab, the arms and the base web forming a housing chamber for the tying element, each of the arms defining an aperture extending therethrough and the apertures being aligned along an axis that is generally perpendicular to said generally planar surface of the base arm, the fastening mechanism further comprising a reversing element for the tying element mounted within the housing chamber, the reversing element comprising a spherical ball having a diameter exceeding a distance between said inner surfaces of the two arms along said axis such that diametrically opposite portions of said ball are retained within said apertures, said ball being rotatable within the housing chamber.

8. Fastening mechanism for receiving a lace or tape-like tying element, the fastening mechanism comprising a fastening tab and a guiding tab connected to the fastening tab, the guiding tab including two arms spaced apart by a base web extending therebetween, the arms and base web together defining a housing chamber for receiving the tying element therethrough, the guiding tab further including a reversing element for the tying element in the form of a cylindrical projection extending between the arms, the projection (22) being connected in one piece with a bearing arm (11) or a cover arm (17) of the guiding tab (9) an being in the form of a hollow cylinder.

9. Fastening mechanism according to claim 8, characterised in that an end region of the projection (22) opposite the bearing arm (11) or cover arm (17) is spherical or ball-shaped.

10. Fastening mechanism for receiving a lace or tape-like tying element, the fastening mechanism comprising a fastening tab and a guiding tab connected to the fastening tab, the guiding tab including two arms spaced apart by a base web extending therebetween, the arms and base web together defining a housing chamber for receiving the tying element therethrough, the guiding tab further including a reversing element for the tying element extending between the arms, and a clamping element which is arranged on the housing chamber and has a recess in which the reversing element is arranged.

11. Fastening mechanism according to claim 10, characterised in that the clamping element (45) comprise a fastening arm (46) connected immovably with the fastening tab (4) by one or more fastening elements (7) and a clamping (47) comprising the recess (48) and inclined toward one of the cover arm (17) and the bearing (11).

12. Fastening mechanism according to claim 11, characterised in that at least one of the fastening tab (4) and the guiding tab (9) and the clamping element (45) is made of a non rusting material.

13. Fastening mechanism according to claim 11, characterised in that a supporting web is formed by an inclined arm (32) running parallel to the clamping arm (47), which connects an extension (52) of the fastening tab (4) with the cover arm (17).

14. Fastening mechanism according to claim 10, wherein the reversing element comprises a projection affixed to one of the arms and extending toward the other arm.

15. Fastening mechanism according to claim 10, wherein the reversing element comprises a rotary body rotatably journaled between the arms.

16. Fastening mechanism according to claim 15, wherein the rotary body comprises a spherical member.

17. Fastening mechanism according to claim 15, wherein the rotary body comprises a cylindrical member.

* * * * *

UNITED STATES PATENT AND TRADEMARK OFFICE

CERTIFICATE OF CORRECTION

PATENT NO. : 6,081,977
DATED : July 4, 2000
INVENTOR(S) : Mark et al.

It is certified that error appears in the above-identified patent and that said Letters Patent is hereby corrected as shown below:

Title page, Item [54], Column 1,
Lines 1, and 2, in the title: "CLOSURE FOR FOOTWEAR, CLOTHING, TENTS, RUCKSACKS" should read -- FASTENING MECHANISM FOR SHOES, ARTICLES OF CLOTHING, TENTS, RUCKSACKS, ETC. --.

Title page, Item [76],
In the inventor's Addresses, lines 1 and 2, "Phyhrn" should read -- Pyhrn --.

Column 1,
Line 54, "An embodiment according to claim 2" should read -- Another embodiment of the invention in which the reversing element is a rotary body --;
Line 59, "rotably" should read -- rotatably --;
Line 66, "rotably" should read -- rotatably --.

Column 2,
Line 6, "rotably" should read -- rotatably --;
Line 18, "which" should read -- with --.

UNITED STATES PATENT AND TRADEMARK OFFICE

CERTIFICATE OF CORRECTION

PATENT NO. : 6,081,977
DATED : July 4, 2000
INVENTOR(S) : Mark et al.

It is certified that error appears in the above-identified patent and that said Letters Patent is hereby corrected as shown below:

Column 9,
Line 4, after "fastening" insert -- tab --;
Line 42, "an" should read -- and --.

Column 10,
Line 20, after "clamping" insert -- arm --;
Line 22, after "bearing" insert -- arm --.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*